US008519623B2

(12) United States Patent
Koger et al.

(10) Patent No.: US 8,519,623 B2
(45) Date of Patent: Aug. 27, 2013

(54) HIGH-PRESSURE DISCHARGE LAMP HAVING A COOLING ELEMENT

(75) Inventors: Rainer Koger, Berlin (DE); Adam Kotowicz, Berlin (DE); Bernhard Winzek, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/320,747

(22) PCT Filed: Apr. 22, 2010

(86) PCT No.: PCT/EP2010/055328

§ 371 (c)(1), (2), (4) Date: Nov. 15, 2011

(87) PCT Pub. No.: WO2010/130544

PCT Pub. Date: Nov. 18, 2010

(65) Prior Publication Data

US 2012/0062097 A1 Mar. 15, 2012

(30) Foreign Application Priority Data

May 15, 2009 (DE) ..... 10 2009 021 524

(51) Int. Cl.
*H01J 5/46* (2006.01)

(52) U.S. Cl.
USPC ..... 313/625; 313/623; 313/46; 313/43

(58) Field of Classification Search
USPC ..... 313/623–625, 11–47
See application file for complete search history.

(56) References Cited

U.S. PATENT DOCUMENTS

| | | | | |
|---|---|---|---|---|
| 2001/0010447 | A1 * | 8/2001 | Yamane et al. | 313/623 |
| 2008/0218049 | A1 * | 9/2008 | Shirasu et al. | 313/46 |

FOREIGN PATENT DOCUMENTS

| | | | |
|---|---|---|---|
| EP | 1 677 332 | | 7/2006 |
| GB | 691 297 | | 5/1953 |
| JP | 62 120255 | | 7/1987 |
| JP | 8 250071 | | 9/1996 |
| JP | 2000 075496 | | 3/2000 |
| JP | 2002 075014 | | 3/2002 |
| JP | 2003 017003 | | 1/2003 |
| JP | 2003059454 | A * | 2/2003 |
| JP | 2003 132781 | | 5/2003 |
| JP | 2003 297228 | | 10/2003 |
| JP | 2008305782 | A * | 12/2008 |
| WO | WO 2007/000141 | | 1/2007 |

* cited by examiner

*Primary Examiner* — Mariceli Santiago
(74) *Attorney, Agent, or Firm* — Cozen O'Connor

(57) ABSTRACT

A high-pressure discharge lamp comprising two electrodes (16, 18), which are arranged facing each other in a discharge vessel (6) and are each in electric contact via a current feed system (20, 24, 26, 28, 30), wherein each current feed system penetrates a piston shaft (9,10) arranged in a gastight manner on the discharge vessel (6), wherein in the region of the outer current feed (28, 30) of at least one piston shaft (9) a cooling element (12) is arranged, and wherein the outer current feed (28, 30) and the cooling element (12) are in direct thermal and electric contact.

13 Claims, 2 Drawing Sheets

HIGH-PRESSURE DISCHARGE LAMP HAVING A COOLING ELEMENT

RELATED APPLICATIONS

This is a U.S. National Stage of application No. PCT/EP2010/055328, filed on Apr. 22, 2010.

This application claims the priority of German patent application no. 10 2009 021 524.7 filed Nov. 14, 2008, the entire content of which is hereby incorporated by reference.

FIELD OF THE INVENTION

The invention relates to a high-pressure discharge lamp.

BACKGROUND OF THE INVENTION

Such lamps have a discharge vessel filled with a discharge medium, for example, a noble gas—with or without the addition of mercury and any other additional fillings. Two electrodes are arranged facing each other inside the discharge vessel. Two piston shafts are arranged on the discharge vessel, via which current feed elements are fed in a gastight manner to the outside for electric contact. For lamp types operated with direct current, the anode is usually designed with an electrode head with high thermal resistance, in which the radiated heat power is optimized by adequate dimensioning. In contrast, the electrode on the cathode side is designed with a comparatively small, conical electrode head.

High-pressure discharge lamps which emit UV radiation are used for the patterning (lithography) of semiconductors. Suitable mercury vapor short-arc discharge lamps from OSRAM are sold under the product name HBO®. To increase productivity, the semiconductor industry requires powerful discharge lamps which emit UV radiation in the region of the mercury i-line at 365 nm. In operation such discharge lamps may not as a rule exceed a line width (FWHM) of approx. 2.5 nm, so that to increase the radiation intensity the mercury density of the filling cannot simply be increased. This in turn means that the lamp voltage applied to the electrodes cannot be significantly increased either.

One possibility for significantly increasing the radiated power is therefore to increase the lamp current and thereby the electric power for connection purposes. In particular, in the case of HBO IC lamps and an effective supply current of more than 220 A, the sealing elements (e.g. sealing films) become very warm (Joule heat loss). An effort is made to reduce the thermal load of the large anode by diverting part of the heat via the current feed and the supply line on the anode side.

The electrodes are each connected to the respective supply lines via an electrode rod, several molybdenum sealing films and an outer current feed which penetrates the piston shaft on the front side, as a rule the supply on the anode side being via a flexible supply line which extends from the lamp axis in an approximately radial direction. The contact on the cathode side is as a rule via a base pin which projects from the base on the cathode side.

In particular, the base on the anode side requires efficient cooling in the case of high-wattage, high-pressure discharge lamps with currents of more than 220 A because as a result of the Joule heat of the sealing films and as a result of the heat conducted by the electrode and also as a result of the heat radiation in a lamp housing (e.g. with lithography use) possibly reflected back, it is heated very intensely. The outer current feed components, which are in direct contact with the ambient atmosphere, can in this case oxidize at temperatures of more than 300° C. during operation of the lamp and then lead to the failure of the discharge lamp.

To improve cooling a solution is shown in WO 2007/000141 A1 in which the base is designed with cooling fins on the anode side in order to expand the heat exchange surface. With such a solution, there is also the problem that the thermal contact between the base and the outer current feed is only made indirectly by welding the supply line to the outer current feed on the one hand and to the base on the other hand. I.e. the section of the supply line between the outer current feed and base wall represents a kind of heat bridge, the size of which on account of the length of the supply line between power supply and base peripheral wall and the small supply cross-section is too small, however, to ensure adequate heat dissipation from the outer current feed to the base. I.e. even in the case of a base with heat fins, on account of the poor thermal contact between outer current feed and base, overheating is not ruled out.

SUMMARY OF THE INVENTION

One object of the invention is to create a high-pressure discharge lamp in which thermal problems are reduced. An additional object of the invention is to be able to ensure operating currents of more than 220 A.

According to one aspect of the invention, the high-pressure discharge lamp has two electrodes which are arranged facing each other in a discharge vessel and are each in electric contact via a current feed system (internal current feed, gastight current feed and outer current feed). The current feed systems each penetrate a piston shaft attached in a gastight manner to the discharge vessel, on which a base can be arranged, there being a cooling element in the area of the outer current feed of at least one piston shaft. According to the invention this cooling element and the outer current feed are in direct thermal and electric contact. I.e. contact does not take place—as in the prior art—via a bridge formed by a supply section but extensively by means of the corresponding design of the outer current feed and of the cooling element.

In this way it is possible to dissipate a sufficient heat flow via the outer current feed and the cooling element to the surroundings so that overheating and thus oxidation of the components of the current feed system can be prevented.

In a preferred exemplary embodiment the cooling element is designed as a base so that the high-pressure discharge lamp has a very simple construction and furthermore optimum heat dissipation is ensured by direct thermal and electrical contact between outer current feed and base/cooling element.

Heat dissipation can be improved if the cooling element is designed with geometry which expands the heat exchange surface. This can, for example, be by means of cooling fins which preferably extend in a radial direction.

It is preferred if the diameter of the cooling fins tapers away from the piston shaft in order to avoid shadowing effects in an imaging device as far as possible.

In such a variant the diameter can be reduced in such a way that a conical cooling fin structure is produced in the lateral view.

In a particularly simple exemplary embodiment the outer current feed and the cooling element are designed as one piece made from a single component.

In this variant the best possible heat transfer and thus efficient cooling is guaranteed. In order to remedy manufacturing disadvantages of such an embodiment, direct contact between heat sinks and outer current feed can take place in an appropriate way by means of clamping, pressing, bolting, welding or the like. The advantages of a welded version correspond to those of a one-piece embodiment, wherein various materials can be used for current feed and cooling element when welding.

In an additional embodiment the cooling element is made of multiple parts, wherein the cooling element parts together form a receptacle which an end section of the outer current feed penetrates.

To improve the contact a thermal compound or the like can be arranged in the transition area between the cooling element and the outer current feed.

In a compact exemplary embodiment the base on the anode side surrounds the assigned piston shaft.

BRIEF DESCRIPTION OF THE DRAWINGS

The invention is explained in more detail below with reference to preferred exemplary embodiments as follows.

DETAILED DESCRIPTION OF THE DRAWINGS

The invention is described below on the basis of an HBO® mercury vapor high-pressure discharge lamp which is used, for example, in microlithography to produce semiconductors. As mentioned at the beginning, the invention is not restricted to such types of lamp however. Rather, the advantages according to the invention also appear in other discharge lamps, for example, in xenon short-arc lamps (OSRAM XBO®). In a xenon short-arc lamp, a discharge arc burns in an atmosphere of pure xenon gas (or xenon gas mixture) under high pressure. XBO lamps are used, for example, in traditional and digital film projection.

Figure 1:
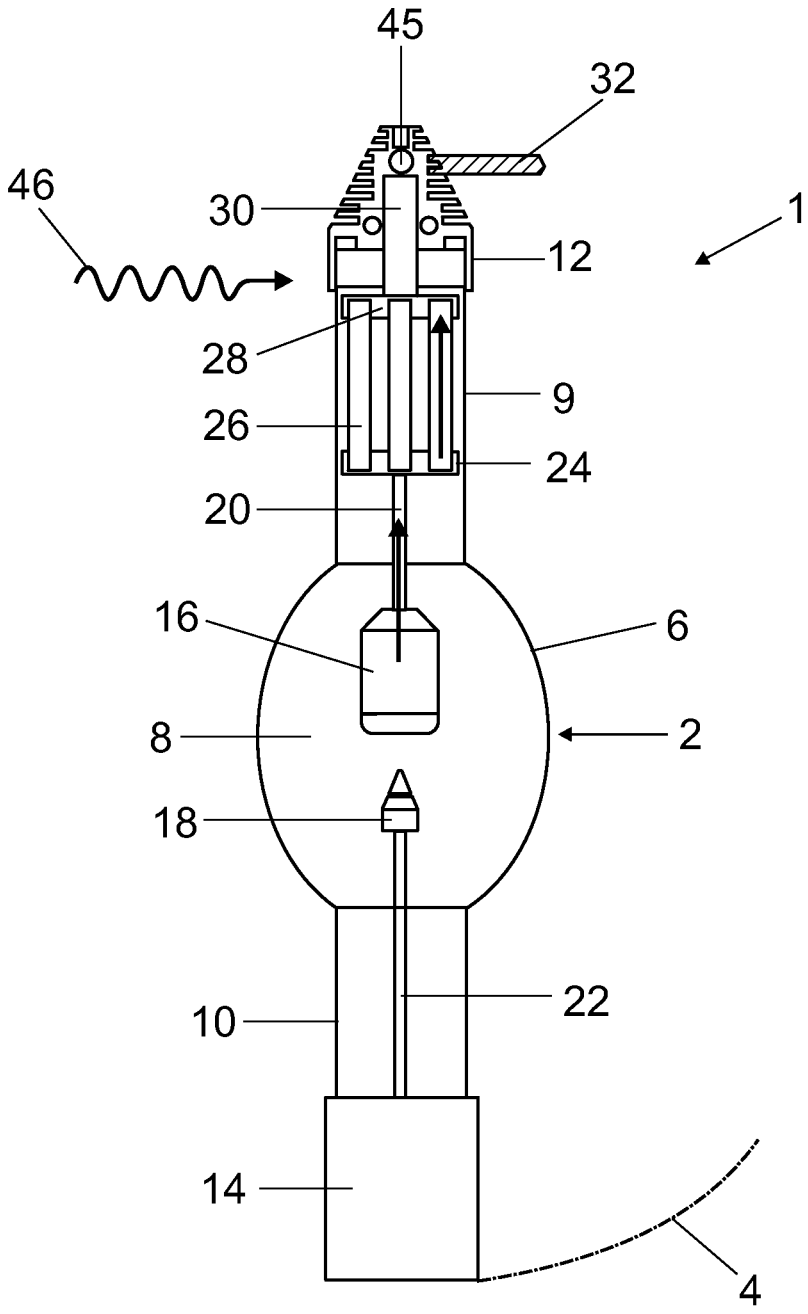
FIG. 1 a diagram of a high-pressure discharge lamp according to an embodiment of the invention.

The highly schematic representation according to FIG. 1 shows a reflector high-pressure discharge lamp 1 with a mercury vapor short-arc discharge lamp 2, which is arranged in the optical axis of a reflector 4 indicated by dotted lines of a lamp house (not shown). The high-pressure discharge lamp 2 designed using short-arc technology has a discharge vessel 6 which surrounds a discharge chamber 8. On the discharge vessel 6 there are two diametrically opposed sealed piston shafts 9, 10 which have a cooling base 12 on the anode side and a base sleeve 14 on the cathode side. The discharge chamber 8 contains an ionizable filling which essentially consists of mercury, and a noble gas mixture.

The electrode 18 forming one cathode is designed with an approximately conical electrode head, while the electrode 16 forming an anode 16 is approximately barrel-shaped or cylindrical with much larger dimensions. Both electrodes 16, 18 are each held by electrode rods 20, 22 which penetrate the respectively assigned piston shaft 9, 10 and have a molybdenum plate 24 on their end section which is connected to the piston shafts 9, 10 with gastight, melted molybdenum films 26. Their end sections are in turn connected to a contact plate 28 which is connected to a rod-shaped current feed 30 projecting from the piston shaft, which is in electric and thermal contact on the anode side with a supply line 32. The contact plate 28 and rod-shaped current feed 30 are designed in one piece here and together form the outer current feed. On the cathode side contact is via a base pin which is not visible in the diagram according to FIG. 1. In order to achieve greater productivity when structuring semiconductors (lithographic layers) the high-pressure discharge lamp 2 according to the invention is operated in the high-wattage range, wherein current densities in the range of more than 220 A can occur.

The reflector 4 (only indicated here) consists, for example, of quartz glass with a reflective coating.

As mentioned at the beginning, in conventional solutions the supply line 32 is welded to the rod-shaped current feed 30 and is also in contact with a base sleeve so that heat transfer from the outer current feed to the base is determined by the cross-section of the supply line 32. According to the invention the cooling base 12 on the other hand is in direct contact with the rod-shaped current feed 30.

Figure 2:
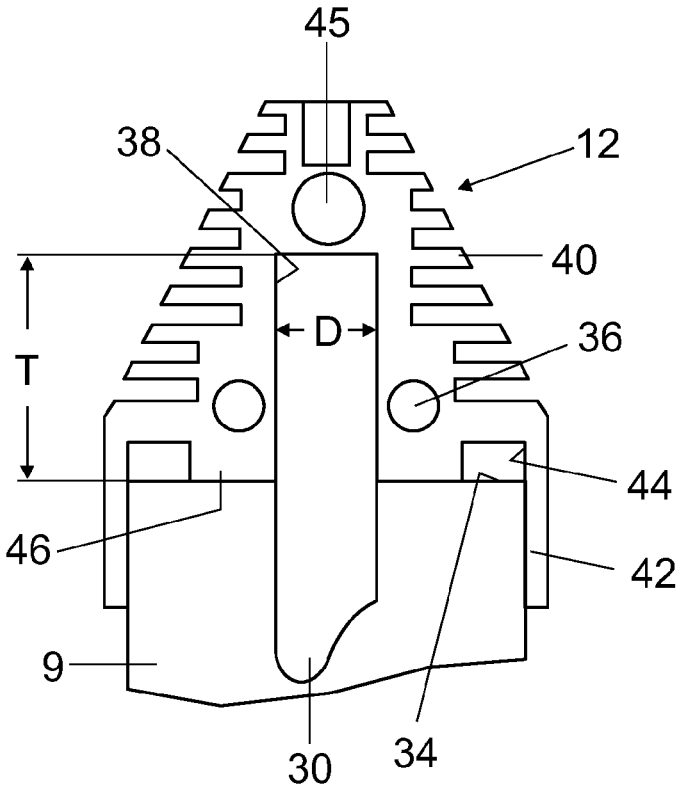
FIG. 2 a detailed representation of a cooling base of the high-pressure discharge lamp from FIG. 1.

Details of this construction are explained on the basis of FIG. 2, which shows an enlarged diagram of the end section on the anode side 5 of the high-pressure discharge lamp 2. This diagram shows the rod-shaped current feed 30 led out of the front side 34 of the piston shaft on the anode side 9, on the end section of which projecting outwards on the front side the cooling base 12 is positioned.

In the exemplary embodiment shown the cooling base 12 is designed in two parts, wherein the junction plane lies in the drawing plane so that the entire cooling base 12 is composed of two cooling base halves which are bolted together. The bolt holes 36 provided for bolting are visible in the diagram according to FIG. 2. Both base parts together form a receptacle the diameter D and depth T of which are adjusted to the corresponding dimensions of the end section of the rod-shaped current feed 30 projecting from the piston shaft 9 so that peripherally and—if possible—also on the front side this fits tightly and extensively to the peripheral or front walls of the receptacle 38 and both with regard to the thermal as well as electric contact a large transition surface is provided. Thermal heat transfer can be further improved if a thermal compound or the like is applied in the area between the receptacle 38 and the rod-shaped current feed 30. The connection between the rod-shaped current feed 30 and the cooling base 12 can—as described—be made by means of bolting. In principle it is also possible for the receptacle 38 and the current feed 30 to be a tight-fitting design so that a tight-fitting or clamp terminal is produced during bolting. Alternatively, the connection can also be made using welding or the like.

To improve the heat exchange surface with the surroundings, on the outer circumference of the cooling base 12 there are a large number of cooling fins 40 extending in a radial direction, the external diameter of which tapers upwards away from the piston shaft 9, i.e. in the diagram according to FIG. 2 so that the external circumference of the cooling base 12 is conical or tapered. On the piston shaft side area of the cooling base 12 there is a centering flange 42 which surrounds the end section of the piston shaft 9 and is also in thermal contact with it. In the process, the centering flange 42 can be linked to the piston shaft 9 using sealant or the like. For electric contact the cooling base 12 has a coupling hole 45 vertical to the lamp axis. However, the rod-shaped current feed 30 can also be in indirect electric contact with the supply 32 via the cooling base 12.

For exact positioning on the front side 34 of the piston shaft 9, in the transition region with the centering flange 42 there is a surrounding annular groove 44 on the cooling base 12 so that this is only positioned on the front face 34 of the piston shaft 9 with a hub-shaped boss 46.

In FIG. 1 the heat flow from the anode 16 via the electrode rod 20 and the molybdenum strips 26 in the direction of the cooling base 12 is shown using straight-line arrows. In addition to the heat input by means of heat transfer from the anode 16 and by means of Joule heat, which arises in the sealing films 26, the cooling base 12 is also heated by the reflected radiation 46 from the reflector 4 (and the exposure unit housing usually used but not shown here). However, this registered heat energy can be transmitted to the surroundings via the current feed 30 and the cooling base 12 in direct contact therewith faster so that thermal damage of the components can be prevented.

In the aforementioned exemplary embodiment the cooling base 12 is designed in several parts. The advantage of such a variant, which for example, is assembled by means of bolts 15, lies in the simpler processing of the discharge lamp when melting down the electrodes, as the base can then be put on after this procedure and therefore does not impede melting down.

Figure 3:
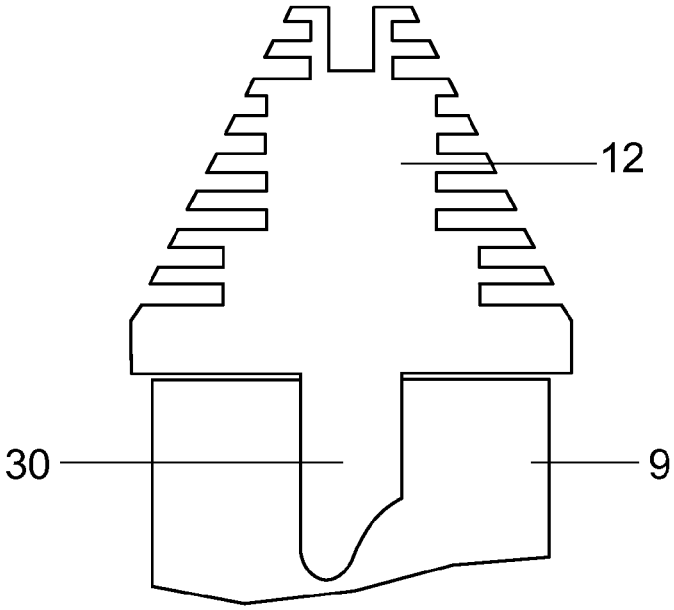
FIG. 3 a further exemplary embodiment of a cooling base for a high-pressure discharge lamp according to FIG. 1.

FIG. 3 shows a solution in which the cooling base 12 and the outer current feed 28, 30 are designed as one piece—such a component with cooling and electric contact function is very easy to produce but has the aforementioned disadvantage that the melting down of the outer current feed 28, 30 and the molybdenum strips described at the beginning—also on account of the improved heat dissipation—can be impeded. In the exemplary embodiment shown in FIG. 3 the centering flange 42 surrounding the piston shaft 9 was omitted as this would hinder melting down additionally.

A further advantage of the embodiment shown in FIG. 3 is that there may not be any gaps preventing heat transfer between the rod-shaped current supply 30 and cooling base 12. Otherwise, the exemplary embodiment shown in FIG. 3 corresponds to the aforementioned variant, making additional explanations unnecessary.

The material of the cooling base 12 is selected with regard to the thermal and electric contact, wherein outer current feed 28, 30 and cooling base 12 may consist of different materials. Of course, the shape of the cooling fins 40 may also be appropriately adjusted to the respective application.

An embodiment of the invention includes a high-pressure discharge lamp having two electrodes arranged in a discharge vessel. Two piston shafts are arranged on the discharge vessel, wherein a current feed system for the electrodes penetrates said shafts. The outer current feed on the anode side is in direct thermal contact with a cooling element.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A high-pressure discharge lamp comprising two electrodes, which are arranged facing each other in a discharge vessel and are each in electric contact via a current feed system, wherein each current feed system penetrates a piston shaft arranged in a gastight manner on the discharge vessel, wherein in a region of an outer current feed of at least one piston shaft a cooling element is arranged, wherein the outer current feed and the cooling element are in direct thermal and electric contact, wherein the cooling element includes cooling fins that extend in a radial direction, and wherein a diameter of the cooling fins tapers away from the piston shaft.

2. The high-pressure discharge lamp as claimed in claim 1, wherein the cooling element is configured as a base.

3. The high-pressure discharge lamp as claimed in claim 1, wherein a surface of the cooling element has an expanding geometry.

4. The high-pressure discharge lamp as claimed in claim 1, wherein the cooling element is conical in shape.

5. The high-pressure discharge lamp as claimed in claim 2, wherein the outer current feed and the cooling element are formed as one piece.

6. The high-pressure discharge lamp as claimed in claim 2, wherein the cooling element includes multiple parts and forms a receptacle for the outer current feed.

7. The high-pressure discharge lamp as claimed in claim 1, wherein the outer current feed is connected to the cooling element using clamping, welding, or bolting.

8. The high-pressure discharge lamp as claimed in claim 1, wherein contact surfaces between the outer current feed and the cooling element have a heat conducting layer.

9. The high-pressure discharge lamp as claimed in claim 1, wherein the cooling element encompasses the piston shaft in sections.

10. The high-pressure discharge lamp as claimed in claim 1, which is formed as a mercury vapor short-arc discharge lamp.

11. The high-pressure discharge lamp as claimed in claim 10, which is adapted for use of the i-line at 365 nm.

12. The high-pressure discharge lamp as claimed in claim 1, which is adapted for an effective lamp current of at least 220.

13. A high-pressure discharge lamp comprising two electrodes, which are arranged facing each other in a discharge vessel and are each in electric contact via a current feed system, wherein each current feed system penetrates a piston shaft arranged in a gastight manner on the discharge vessel, wherein in a region of an outer current feed of at least one piston shaft a cooling element is arranged, wherein the outer current feed and the cooling element are in direct thermal and electric contact, wherein the cooling element is configured as a base, and wherein the outer current feed and the cooling element are formed as one piece.

* * * * *